United States Patent [19]

Horng

[11] Patent Number: 4,799,272

[45] Date of Patent: Jan. 24, 1989

[54] ROLL-UP FLUSH TOILET

[76] Inventor: Weiyo Horng, No. 41, Yu Lo Street, Taoyuan, Taiwan

[21] Appl. No.: 111,993

[22] Filed: Oct. 21, 1987

[51] Int. Cl.[4] ..... E03D 11/12
[52] U.S. Cl. ..... 4/312
[58] Field of Search ..... 4/312, 627, 624, 626, 4/663

[56] References Cited

U.S. PATENT DOCUMENTS

| | | | |
|---|---|---|---|
| 2,826,762 | 3/1958 | Colonna | 4/312 |
| 2,879,519 | 3/1959 | Mueller | 4/312 |
| 3,436,764 | 4/1969 | Colonna | 4/312 |

FOREIGN PATENT DOCUMENTS

| | | | |
|---|---|---|---|
| 2467920 | 5/1981 | France | 4/627 |

*Primary Examiner*—Werner H. Schroeder
*Attorney, Agent, or Firm*—Darby & Darby

[57] ABSTRACT

A roll-up flush toilet is composed of a base and a body. A rotary mechanism in the base may rotate to make the body in a level position or upright position. When the body is set in a level position, the body may be used for elimination purposes. When the body is set in an upright position, the sitting ring of the flush toilet still remains unexposed and is therefore extremely neat and clean. Further, a recess is formed on the bottom face of the body, which recess can serve as a urinal in which a male may urinate.

4 Claims, 3 Drawing Sheets

ROLL-UP FLUSH TOILET

BACKGROUND OF THE INVENTION

1. Field of the Invention

This invention relates to a sitting flush toilet and in particular a roll-up flush toilet.

2. Background Prior Art

All conventional sitting flush toilets are set on the floor in a level position. Since they are set on the floor in a level position, their recesses to receive fecal matter often protrude forward and are exposed over the outer surface and are aesthetically unpleasing. Although the recess to receive the fecal matter can be covered by a cover, if these old type flush toilets are set in a level position, they have to occupy a larger space. As a result, nobody finds them really acceptable and this is the reason why all such flush toilet arrangements are installed in a separate isolated and closed empty room. This arrangement is prevalent, without exception, even in hospitals where people may use the flush toilet more often. Patients in hospitals, particularly patients with heart disease in intensive care wards, and female patients (including women in maternity) are basically quite feeble and often unable to move freely. They often have a physical condition such that they are hardly able to support themselves or have a room at some distance away from their wards or beds. Thus, the process of elimination may appear as if it were a mistreatment. As for other places, for instance, in a swimming pool or in a stadium, the shower room and lavatory are always provided separately, which is often very inconvenient.

Further, when the conventional flush toilets are set at a level position, even though they do not occupy a very large space, in a highly populated city, especially, in sections or business areas having highly prices land, the value of the space occupied by these flush toilets is still considerably large. Further, the recess of the flush toilet for receiving the fecal matter is exposed when the flush toilets are set in a level position. This can give a poor aesthetic impression. Accordingly, the value of the area in which the flush toilets are installed cannot easily increase.

Still further, the conventional flush toilet has only one recess to receive the fecal matter. The bottom of the recess is connected to the disposal system in a building. Therefore, all the fecal matters released by the people therein can be disposed and discharged therefrom. Although both female and male can use this kind of flush toilets for elimination and urination, when a male urinates over the flush toilet, he will usually wet the sitting ring by dripping some urine drops on it. Therefore, if and when another person who comes next wishes to use the flush toilet, he (she) must first wipe the sitting ring and then use the flush toilet. This often annoys this next user. To avoid this, generally additional upright urinals are provided at public places separately for males to urinate. Although separate urinals are additionally provided to avoid the sitting rings of flush toilets from becoming fouled, additional separate arrangement and space are needed for these urinals. Further, the cost of such facilities becomes very high. To a population-increasing modern city with limited living space, this is, in practice, a considerable burden.

SUMMARY OF THE INVENTION

In view of the above, this invention provides a roll-up flush toilet to overcome the defects found in conventional flush toilets. In such a roll-up flush toilet according to the present invention, upon completion of using the toilet, the body of the toilet can be turned up, so that the recess to receive the fecal matter is not exposed and the surface of the toilet can maintain a smooth, beautiful look. Besides, compared to conventional flush toilets, the present invention takes considerably less space. Accordingly, more places can employ this invention, for instance: a shop, household ward, or gymnasium. Consequently, this invention reduces inconvenience and waste of space, which is a primary object of the present invention.

The roll-up flush toilet according to the present invention, in addition to having a recess to receive fecal matter, can be used as a urinal, but the recess and urinal may be used separately, so that there will be no such thing as the sitting ring of a flush toilet to be fouled by a male's urine. Thus, people will be totally free from the annoyance of wiping the sitting ring dry and clean first, which is another object of the present invention.

The flush toilet according to the present invention has a urinal and a flushing mechanism, so that the flush toilet can save costs of the facilities and space in a public shower rooms, which is a further object of the present invention.

A more complete understanding of these and other features and advantages of the present invention will become apparent from a careful consideration of the following detailed description of certain embodiment illustrated in the accompanying drawings.

DESCRIPTION OF THE PREFERRED EMBODIMENTS

The main characteristic of the present invention lies in that this kind of flush toilet according to the invention is composed of a separable base and body. The body employs a rotary mechanism to join the body into an integral identity and also rotates on the base so as to be in a level state or in an upright state. When the body is set in a level state, the body has a recess which starts from the top face and slopes downward to receive fecal matter. After the bottom of the recess goes through an S-shaped water storage bend, the bottom of the recess has a hole which communicates with the fecal matter disposal system in the building so as to make the fecal matter enter the disposal system and be treated therein and then be discharged therefrom. Another recess may or may not be provided on the other side of the body and if, it is, the recess may be exposed when the body is in an upright state so as to make the entire flush toilet become a urinal. This feature, therefore, can make the invention available for all users (male and female) to eliminate fecal matter and for only the male to urinate without showing any of the defects of the conventional flush toilets. If no recess is provided thereon, when the body stands at an upright position, the entire surface is very even so its value is greatly heightened and its scope of usage is also greatly expanded.

Figure 1:
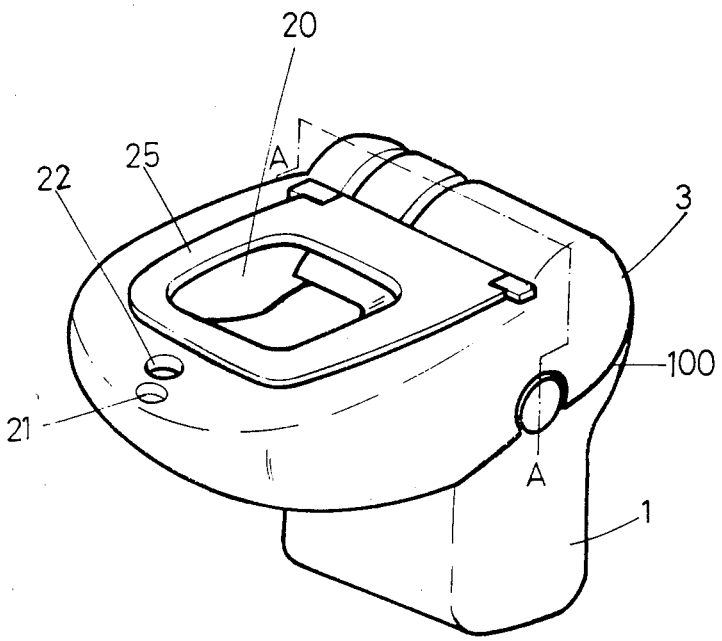
FIG. 1 is a perspective view of a preferred embodiment of this invention with the body set in a level position.
Figure 2:
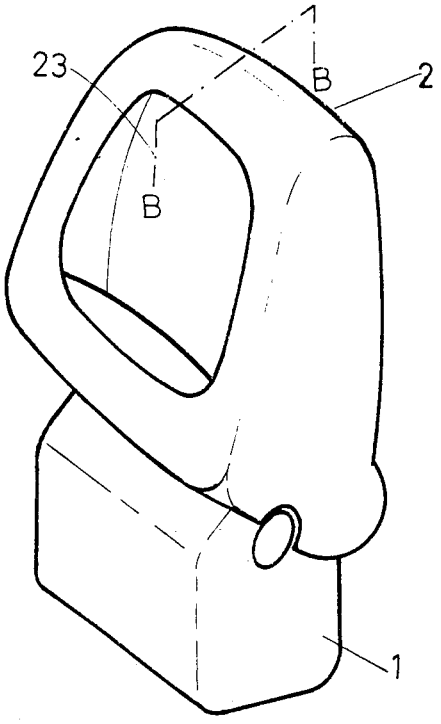
FIG. 2 is a perspective view of the preferred embodiment of this invention in a upright position shown in FIG. 1.

With the above features, the invention may have many types, but the attached drawings illustrate only two preferred embodiments. Therefore, it is clearly expressed herein that all those types having the basic first characteristic of the present invention should be covered in the scope of this case. Referring to FIGS. 1 and 2, the flush toilet according to the present invention has a base 1 and body 2, in which the base 1 is in block form in its outer configuration and its bottom face is plain to solidly bear the weight of the body 1. The surface 100 of the inner rim of the upper part of the body 2 is in an arcuate shape to telescopically join the rear end of the body 2. This allows body 2 to be rotatable on the base 1 so as to become a level state (as shown in FIG. 1) or an upright state (shown in FIG. 2). When the body 2 is in a level state, its top has a recess 20 descending from the top toward the bottom to receive the fecal matter. The bottom face of the recess 20 inclines toward the base 1; the top face of the body 2 is planar; its front edge may be provided with a pair of water inlets 21, 22 to respectively flush the urine and fecal therefrom. A rotary mechanism 3 is provided at the place where the body 2 and base 1 are telescopically joined. When the body 2 is in an upright state, its front face, i.e. the other side of the body opposite to the above recess 20, may also have a recess 23 to receive urine. Therefore, when the body 2 is in an upright state, it serves just as a urinal.

Figure 3:
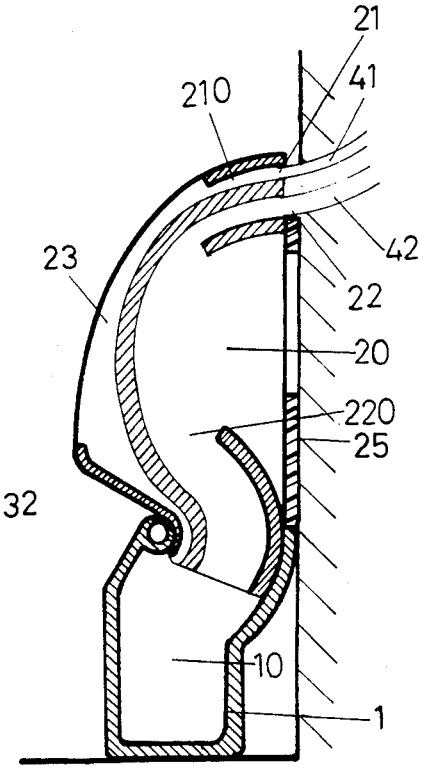
FIG. 3 is a flushing state view (viewed from line B—B) of the preferred embodiment shown in FIG. 2 of the invention.

Referring to FIG. 3, the water inlet 21 and the water inlet 22 to flush the fecal, which are provided on the front edge of the body 2, respectively, communicate to the urine and fecal discharge channels 210, 220 in the inner side of the body 2. The two discharge channels 210, 220 are formed respectively along the bottom face or inner side face of the related fecal and urine recesses 20, 23 and are also in communication with the discharge channel 10 in the base 1. Thus, during the static state or after a user's bowel movement, such a flush toilet still maintains the urinal state, and the two water inlet 21, 22 are respectively in communication with and are connected to the water supply systems 41, 42 provided in the building, for instance, a flush valve or water tank, to expedite the flushing process.

Figure 4:
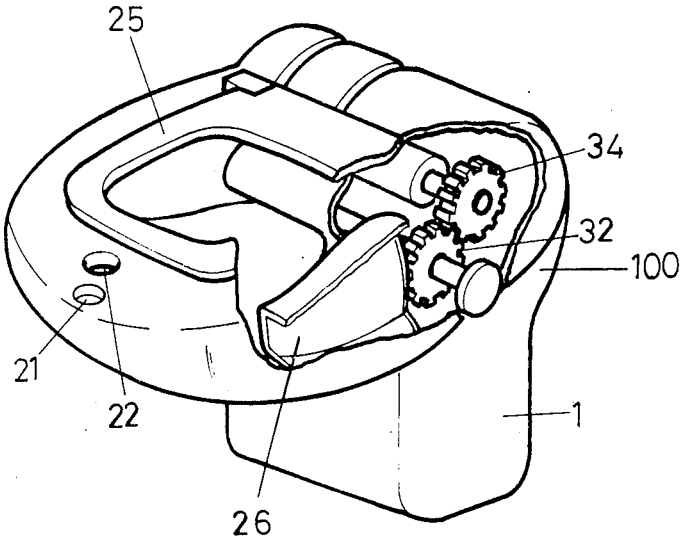
FIG. 4 is an internal structural view of the preferred embodiment shown in FIG. 1 of the invention.

As shown in FIG. 4, in the inner part of the body 2 in the preferred embodiment of the invention, there is a water storage tank 26, the opening of said tank 26 being on the front edge of the body. The bottom of the tank is in the rear part of the body. When the body 2 is set in a level position, the opening of the water storage tank 26 is at a lower position, so that water stored therein can flow out to the recess 20 which receives the fecal matter to form a water surface. This can prevent the fecal matter discharged from being dispersed in a very difficult way by flushing water, and the water tank can store water therein in its upright position.

Figure 5:
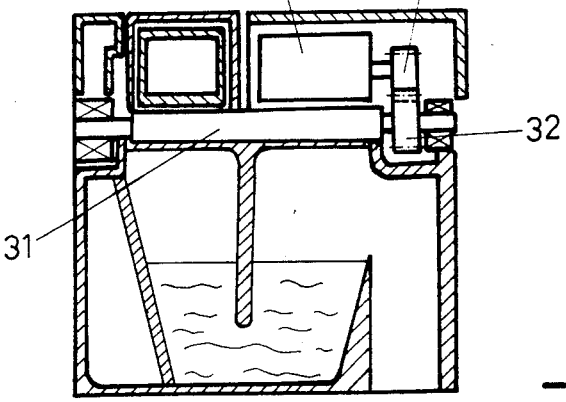
FIG. 5 is a longitudinal cross sectional view of the preferred embodiment of the invention viewed from the line A—A in FIG. 1.

The rotary mechanism 3 in this invention is installed between the body 2 and base 1. One of its preferred embodiments is shown in FIG. 5, wherein a shaft body 31 is provided on the top of the body 2 and has a driven gear 32 and an electric motor 33 is provided in the base 1. A drive gear 34 on the rotary shaft of the electric motor 33 engages the above driven gear 32, so when, upon completion of one's bowel movement in the toilet room, the user causes the motor to be started which, in turn, makes the gear 34 drive the shaft body into rotation so as to make the body rotate until the body 2 enters an upright position. Then, the user proceeds to make the water supply system 42 use the water valve to supply water to the water inlet 22 for flushing. The above-said rotary mechanism can also utilize the hydraulic drive means which can be replaced in a simple manner.

Figure 6:
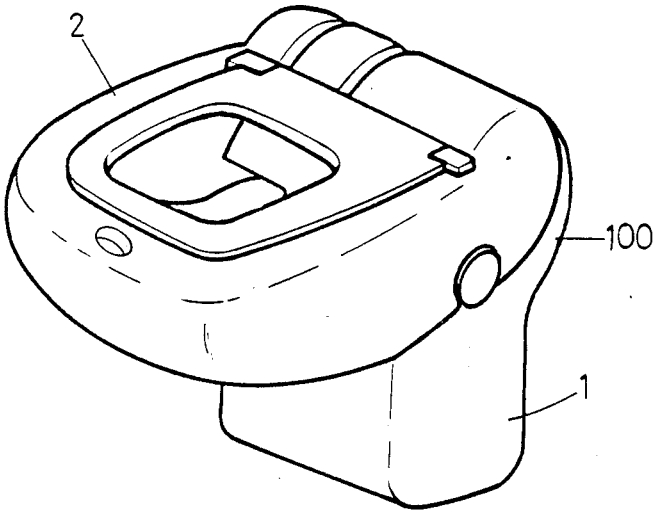
FIG. 6 is another preferred embodiment of the present invention.
Figure 7:
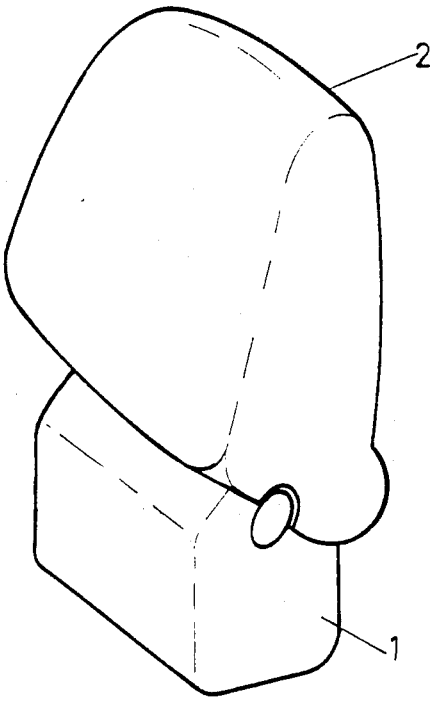
FIG. 7 is a view showing the roll-up state of the flush toilet at usual times in the preferred embodiment shown in FIG. 6.

Another preferred embodiment of the present invention is shown in FIG. 6 and differs from the above embodiment in that no recess is formed on the lower side face of the body, and, therefore, there is no need to provide a water inlet 21 to flush the urine and its water discharge channel 210. Thus, when the body is in an upright position as shown in FIG. 7, because the recess to receive the fecal matter leans on the wall, its surface is flush and will not affect the space, as to display and design, that it saves due to its existence. Further, the saved space may be used for a shower.

The roll-up flush toilet according to the present invention will take up less space than the conventional flush toilets and will enjoy a wider scope of applicable places for use. In particular, the one not formed with a urinal, after it is set in an upright position, can still maintain an intact plain, smooth, beautiful look, thereby enhancing the value of the space in the building. When it is formed with a urinal, the situation where the sitting ring of the flush toilet could become fouled with urine will be avoided. Thus, people will be free from having to first, wipe the sitting ring of the flush toilet dry and clean prior to use. Thus, the invention is a truly practical one with widespread potential use.

While the foregoing description and drawings represent the preferred embodiments of the present invention, it will be obvious to those skilled in the art that various changes and modifications may be made therein without departing from the true spirit and scope of the present invention.

I claim:

1. A flush toilet comprising:

a base having a discharge passage;

a body rotatably connected to said base, said body having a top and bottom face, said top face having a first recess for normal waste discharge when said body is in a level position and said bottom face having a second recess when said body is in an upright position for service as a urinal, said second recess being uncovered in said upright position; and rotating means provided between body and base for selecting either level or upright position of said body;

said first and second recess body including passages for allowing said recess to communicate with said discharge passage of said base.

2. The flush toilet of claim 1 wherein said second recess is centrally located on said bottom face of said body.

3. The flush toilet of claim 1 wherein said body includes a first and second compartment for connection to said first and second recesses respectively, each compartment having a respective opening adapted to be connected to a supply of water for flushing purposes.

4. The flush toilet as claimed in claim 1, wherein the side of the body having said first recess includes a water storage tank having an opening and a tank bottom, the opening of the water storage tank being located at a front edge of the body, the tank bottom being located at a rear part of the body, so that when the body is set in a level position, the opening of the water storage tank is in a lower position.

* * * * *